US006475056B1

(12) United States Patent
Christianson

(10) Patent No.: US 6,475,056 B1
(45) Date of Patent: Nov. 5, 2002

(54) DEVICE AND METHOD FOR SECURING MOVABLE SECTIONS OF WIND INDICATOR DEVICES AND KITES

(75) Inventor: James David Christianson, Colchester, CT (US)

(73) Assignee: Go Fly A Kite, East Haddam, CT (US)

( * ) Notice: Subject to any disclaimer, the term of this patent is extended or adjusted under 35 U.S.C. 154(b) by 0 days.

(21) Appl. No.: 10/083,141

(22) Filed: Feb. 27, 2002

(51) Int. Cl.[7] ..... A63H 33/40
(52) U.S. Cl. ..... 446/201; 446/218; 446/236
(58) Field of Search ..... 446/176, 199, 446/201, 217, 218, 236; 244/153 A; 40/440

(56) References Cited

U.S. PATENT DOCUMENTS 1,583,881 A 5/1926 Heberling
1,669,748 A 5/1928 Greger
2,086,361 A 7/1937 Kaszas
4,227,406 A 10/1980 Coffey
5,127,358 A 7/1992 Galloway
5,149,020 A * 9/1992 Rundle et al. ..... 244/153 A
5,811,673 A 9/1998 Kwok
6,206,747 B1 3/2001 Skwarek
6,364,732 B1 * 4/2002 Wu ..... 446/217

* cited by examiner

*Primary Examiner*—Jacob K. Ackun
(74) *Attorney, Agent, or Firm*—Jonathan E. Grant; Grant Patent Services

(57) ABSTRACT

The invention discloses colorful wind indicator toys and kites having an improved disk structure for securing various rotatable wind collecting parts of the wind indicators and kites.. More specifically, it is proposed that a hub lock be used instead of a disk type structure to secure the vanes of the wind indicator toys, therein "locking" the projections of the vanes into the hub lock, preventing the vanes or similar structures from disengaging and flying away from the structure during high winds..

30 Claims, 4 Drawing Sheets

DEVICE AND METHOD FOR SECURING MOVABLE SECTIONS OF WIND INDICATOR DEVICES AND KITES

BACKGROUND OF THE INVENTION

1. Field of the Invention

This invention discloses a locking disk to secure the attachments of movable parts to a wind wheel and kites.

2. Description of the Prior Art

In the past, there have been a number of inventions relating to amusement devices based on wind power.

U.S. Pat. No. 1,583,881 (J. Heberling) discloses a pinwheel having a relatively rigid metal center, flexible nonmetallic blades fastened to the center, with each of the blades being individual and being cut as a blank separate from the remaining blades, a portion of each of the blades being curved over the metal center.

U.S. Pat. No. 1,669,748 (G. G. Greger) discloses a pin wheel having a wheel made from a blank provided with curved slits to form a plurality of tapering blades. The wheel has its central portion mounted on the pin with the blade tips brought together on the pin in spaced relation to the central portion of the wheel blank. A baffle on the pin rests against the edges of the gathered tip portions.

U.S. Pat. No. 5,811,673 (Kwok et al.) discloses a wind direction indicator having a rotatable wind vane and a support for connection to the mast of a yacht. The vane is connected to the support by means of a gimbal mechanism and a stabilizing weight is connected to the gimbal mechanism diametrically opposite the vane.

U.S. Pat. No. 4,227,406 (Coffey) discloses a wind direction device for attachment to a boat shroud for indicating the direction of the wind relative to the direction of travel of the boat. The device includes several wraps of adhesive tape around a boat shroud to form an upwardly facing shoulder at a midpoint of the shroud of the boat, a bearing resting on the shoulder and having a hold through which is received the shroud, which bearing as a slit in one side and is sufficiently flexible and resilient so that the size of the slit can be varied to position the bearing around the shroud and retain the bearing on the shroud.

U.S. Pat. No. 5,127,358 (Galloway et al.) discloses an apparent wind direction indicator having a masthead device for sailboats. These marks can be adjusted with greater compass accuracy to allow several settings in each quadrant creating a series of reference points enabling one to more accurately determine the apparent wind angle from a center point and thus optimize sail trim, heading and boat speed.

U.S. Pat. No. 2,086,361 (W. B. Kaszas) discloses an airplane kite with a fan wheel mounted on an extended part of the kite.

U.S. Pat. 6,206,747 (Skwarek) discloses a colorful wind indicator which comprises a tail section for catching wind, a front section for indicating the direction of the wind, a tail mounting section for mounting the tail section, a joinder for joining the tail mounting section with the front section and a pole upon which the assembly rotates. The device taught by this patent (herein incorporated by reference) further comprises two disk type structures, with one of the disk type structures being positioned at a proximal end of said hollow rod closest to said pivot doll, and the other disk type structure being positioned at a distal end of the hollow rod farthest away from said pivot doll, with the disk type structures having a plurality of holes around the circumference of each disk type structure. The wind wheel further comprises vanes for catching the wind, with the vanes having a frame which had projections which fit into the disk type structures. In one embodiment, the ends of the projections are bulbous, and fit into appropriately grooved disk type structures.

This disk type structure has become sort of a standard in the industry, as more and more kite and wind wheel manufacturers have sought to copy this design.

However, the use of the present disk does present certain challenges. During periods of high winds or high torque, the projections of the vanes may become disengaged from the disk type structure, causing the vanes to fly off in extremely high winds. Alternatively, if the disk is used to secure the parts of a kite, such as a propeller, wind forces may cause those parts to separate from the disk type structure, causing the kite to become unbalanced.

SUMMARY OF THE INVENTION

The proposed invention solves these problems by using an improved disk structure. More specifically, it is proposed that a hub lock be used instead of the prior disk type structure to secure rotatable parts driven by the wind, therein "locking" the projections of these parts into the hub lock, preventing the vanes or similar structures from disengaging and flying away from the structure during high winds..

In one embodiment of the invention, the hub lock device is comprised of two interlocking sections. The "male" or top section has pin projections which fit into holes in the "female" or bottom section of the hub device.

In another embodiment of the invention, the hub device is comprised of two sections wherein the two sections are attached by means of a resilient member.

This device may be used to connect various moving parts of the wind wheel to various shafts, thereby allowing for the free rotation of parts. Similarly, this device may also be used to allow for the connection of various parts of a variety of kites.

DETAILED DESCRIPTION OF THE INVENTION

Figure 1:
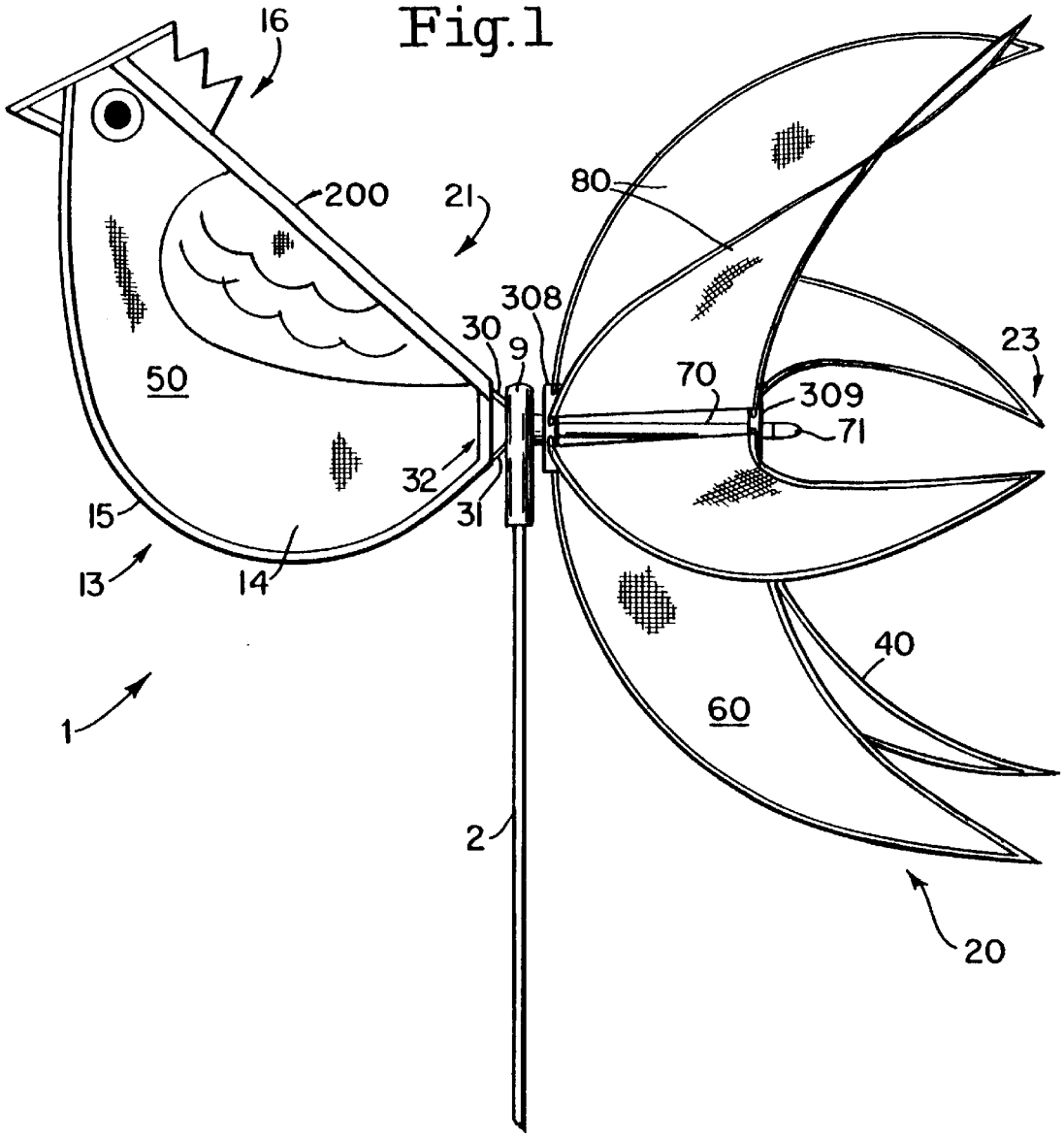
FIG. 1 is a perspective view of the wind wheel.
Figure 4:
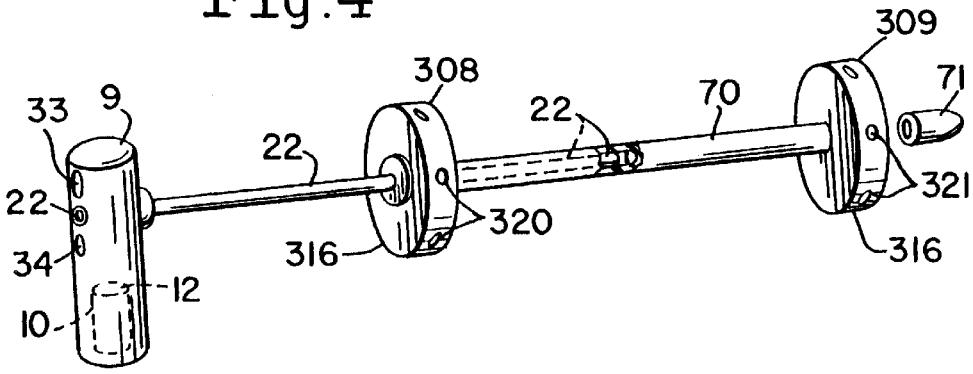
FIG. 4 is a perspective of the support for the back the section of the wind wheel.
Figure 2:
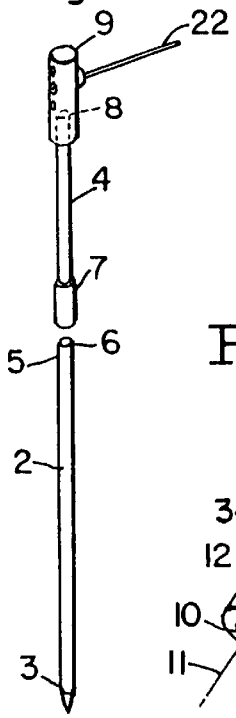
FIG. 2 is a perspective view of the ground stake.
Figure 3:
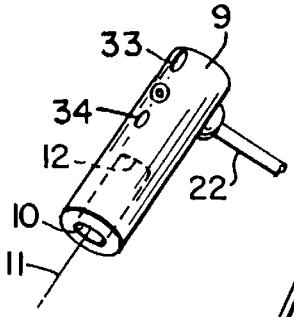
FIG. 3 is a perspective of the hollow doll.
Figure 5:
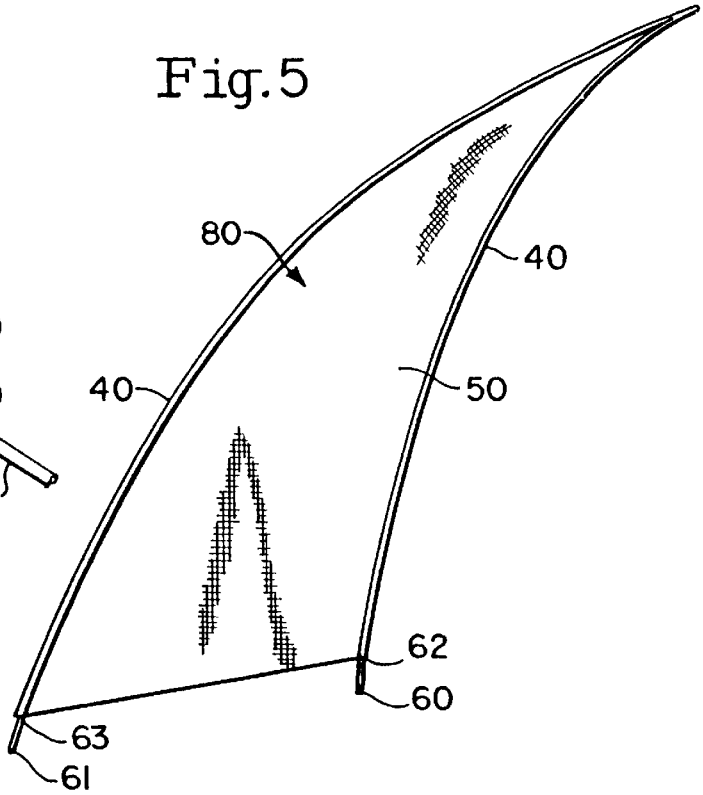
FIG. 5 is a side view of the vane.
Figure 6:
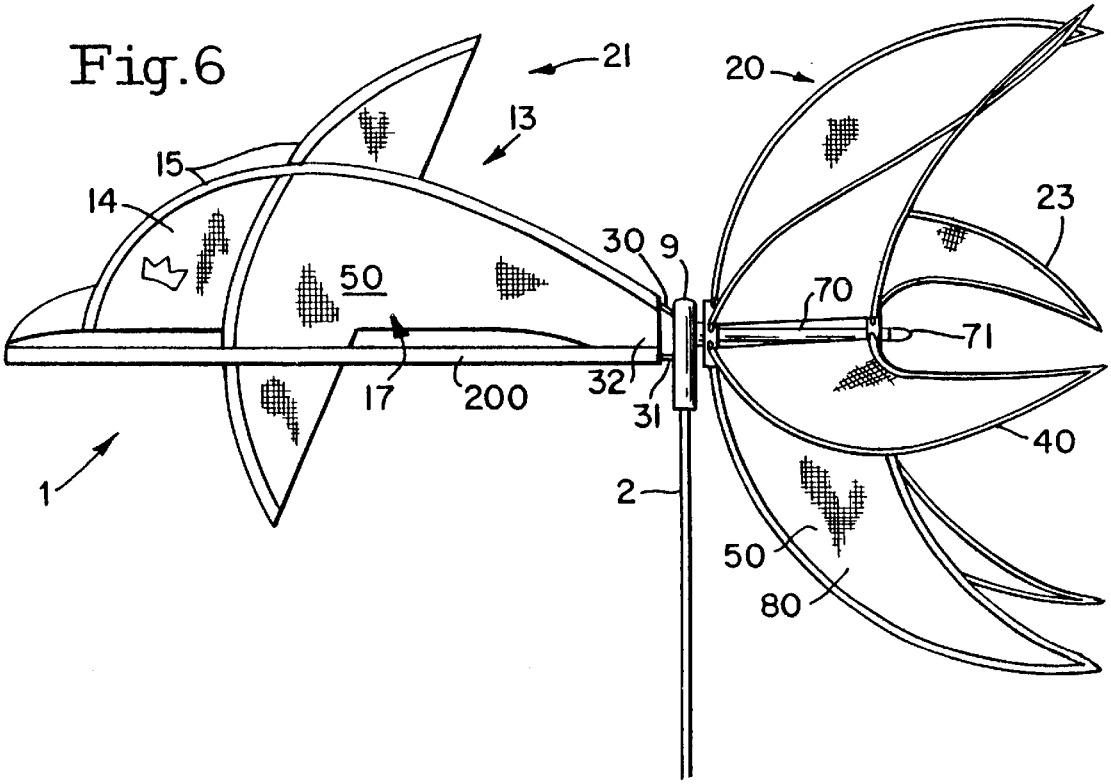
FIG. 6 is a side view of another embodiment of the invention.
Figure 7:
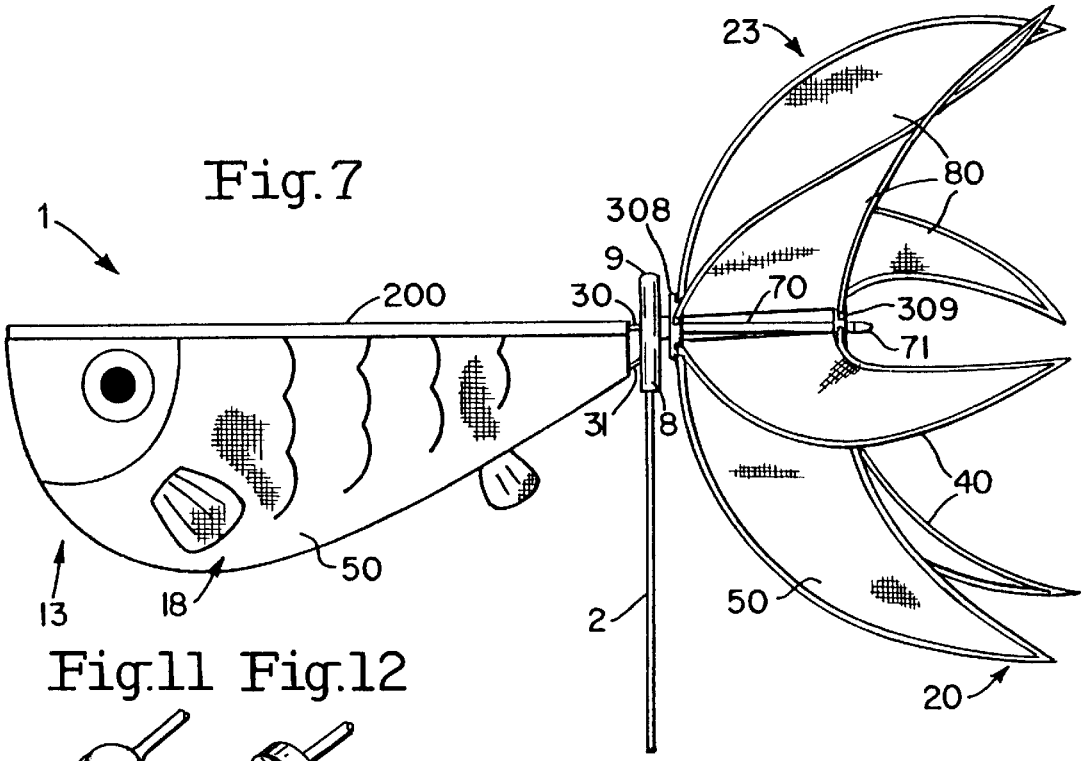
FIG. 7 is a side view of another embodiment of the invention.
Figures 11, 12:
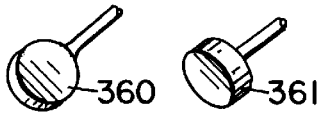
FIG. 11 is a perspective view of the bulbous headed structure.
FIG. 12 is a perspective view of the cylindrical headed structure.
Figure 13:
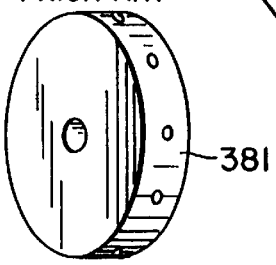
Fig.13 PRIOR ART
FIG. 13 is a perspective view of the cylindrical structure of the prior art.

Referring to FIGS. 1–9, a wind indicator toy 1 shown in FIG. 1 and 2 has a ground stake 2, preferably having a pointed end 3, which can be pushed into the ground. An extension piece 4 can be attached to the top 5 of the ground stake 2 with the ground stake 2 and the extension piece 4 preferably having a male 6 and female 7 connector. At the top 8 of the extension piece 4 or at the top of the ground stake 2, there should be a pivot doll 9. The pivot doll 9 has a hole 10 drilled through its center 11 so that the pivot doll 9 can rotate atop the top of the stake 2 or the extension piece 4. The hole is not drilled completely through the pivot doll 9 at the end 12 of the pivot doll 9 so that the pivot doll does not slip down the stake 2.

Attached to the pivot doll 9 is a front section 13 which holds a directional indicator 14. The directional indicator 14 is a flexible piece of material 50, tightly stretched and supported by a frame 15. The flat piece of material can be in the shape of a bird 16, a dolphin 17, a fish 18, or any other identifiable form. The material 50 used can be nylon, silk, plastic, paper, cloth, or any other type of material which is flexible and durable. It is preferred that the material used be nylon. It is also preferred that the material 50 be made of, or dyed, with bright colors, making it more eye catching.

The frame 15 on which the material is shaped is made out of nylon, wood, or any other 20 sturdy, flexible material. Additional flexible material can be added to outside of the frame to complete the image of the animal or object being portrayed. The frame 15 extends around the periphery or circumference of the material. In a preferred embodiment of the invention, there are two projections 30 and 31 at the end 32 of the frame 15. These two projections 30 31, which are preferably positioned close to each other, fit into holes 33 and 34 found on the pivot doll 9. These two projections reside in the same vertical plane.

Figure 8:
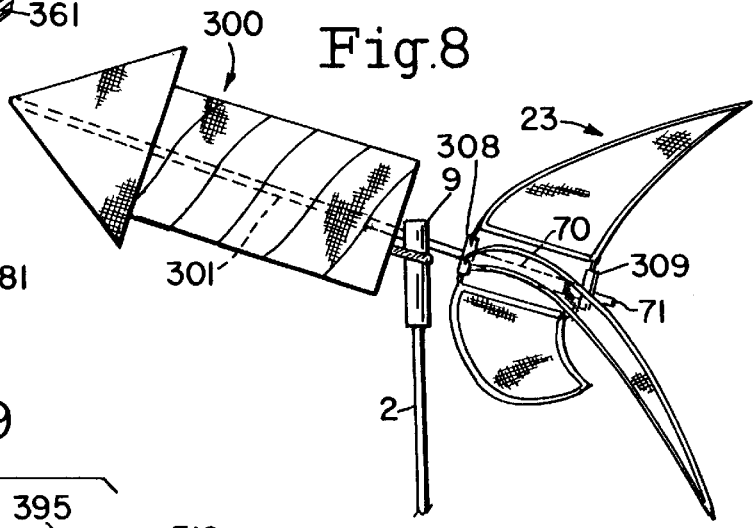
FIG. 8 is a cross view of another embodiment of the front section of the invention.
Figure 9:
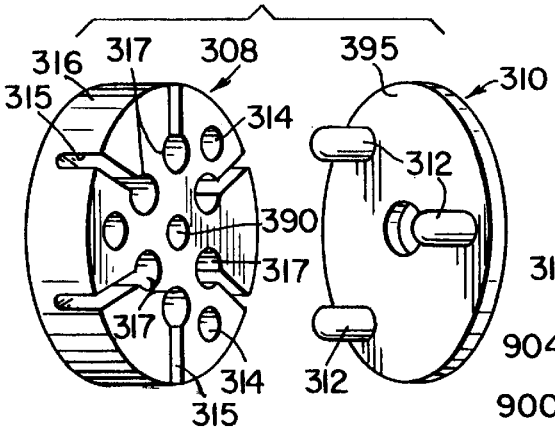
FIG. 9 is a perspective view of the hub lock.
Figure 10:
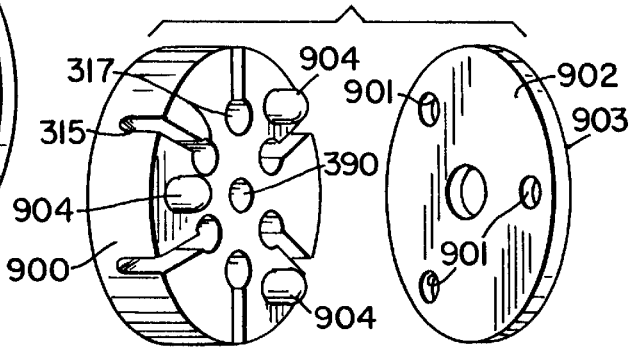
FIG. 10 is a perspective view of another embodiment of the hub lock.
Figure 14:
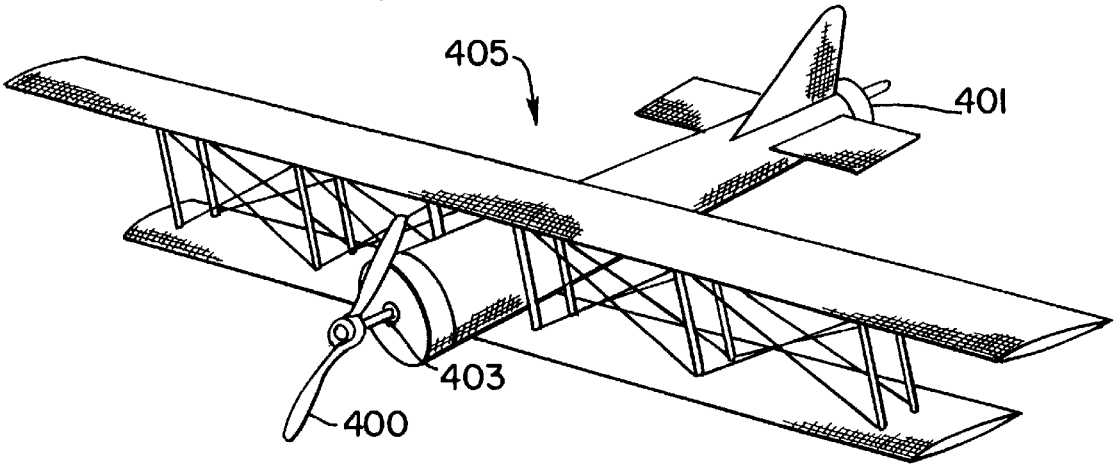
FIG. 14 is a perspective view of an airplane kite.
Figure 15:
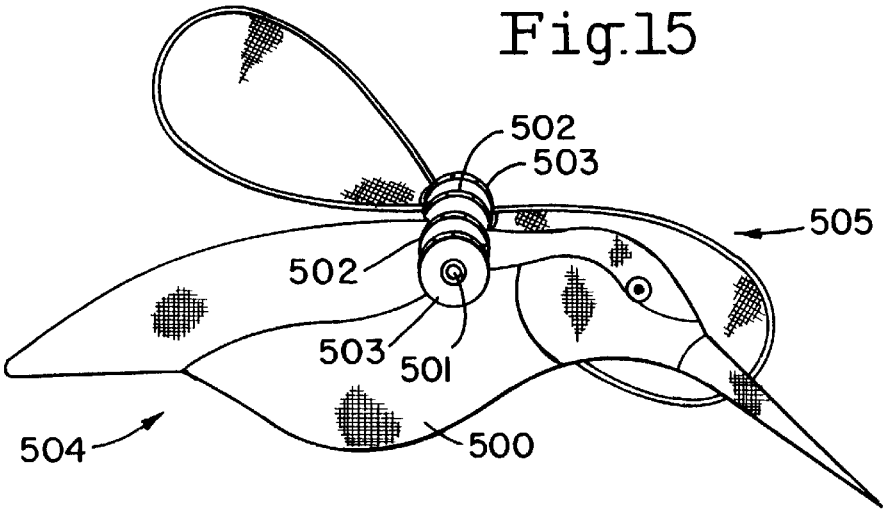
FIG. 15 is a perspective view of an alternative embodiment of a wind wheel.
Figure 16:
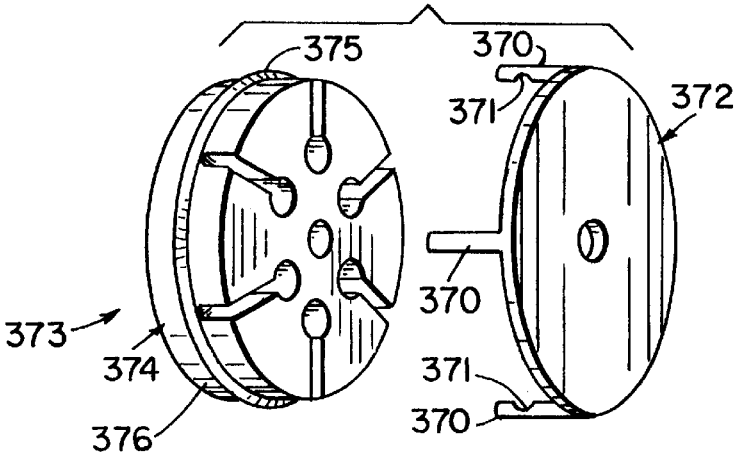
FIG. 16 is a perspective view of an alternative embodiment of a hub lock.

In an alternative version of the invention, as shown in FIG. 8, a framing structure can also, or alternatively be positioned inside 300 the shaped material, wherein a pocket 301 is formed. Projections 302 emanating from that pocket 301 fit into openings into the pivot doll 9.

In a preferred embodiment of the invention, a rigid piece 22, perpendicular and attached to the doll, supports a hollow rod 70 which supports at least one, and preferably several, wind catching tail(s) 23. In a preferred embodiment, the hollow rod 70 slides over the rigid piece 22. The hollow rod 70 is kept in place by means of a cap 71 which fits over the end of the rigid piece 22. The hollow rod 70 preferably rotates freely about the rigid piece 22. This hollow rod 70 has at least one, and preferably two disk type hub locks 308 and 309 having central holes 390 through which the rigid piece fits. The hub locks may be positioned at the proximal and distal ends of the rigid piece.

The two disk type hub locks 308 and 309 preferably have a "top" section 310 and a "bottom" section 311. In one embodiment of the invention, the top section 310 comprises a disk having prongs 312, preferably three prongs 312, usually pin shaped, projecting perpendicularly to the plane of the body 313 of the top section 310. The prongs extend downward from the underside 395 of the top section 312. The bottom section 311 has holes 314 which correspond with the prongs 312. The holes are only large enough to allow for the prongs 312 to fit tightly in the holes 314 of the bottom section 310. Alternatively, prongs 904 may extend from the bottom section 900 to fit into holes 901 positioned in the underside 902 of said top section 903.

The bottom section 310 has openings 315 positioned around the circumference 316 of the hub lock 308, 309. These openings 315 lead into large headed grooves 317.

The back section 20 of the wind wheel serves to capture the wind and thus rotates the entire top structure 21. In order to do this, at least one vane 80, and preferably numerous vanes, in the form of tail-like structures, are affixed to the back section 20, preferably attached to the two disk type structures hub like structures 308 and 309. The vane 80 comprises a piece of flexible material 60, tightly stretched and usually supported by a frame 40. The piece of material can be in the shape of a tail, fin or any other identifiable form. The material 60 used can be nylon, silk, plastic, paper, cloth, or any other type of material which is flexible and durable. It is preferred that the material used be nylon. It is also preferred that the material be made of, or dyed, with bright colors, making it more eye catching.

The frame 40 on which the material is shaped is made out of nylon, wood, or any other sturdy, flexible material. Additional flexible material can be added to outside of the frame to complete the image of the animal or object being portrayed. The frame 40 extends around the periphery or circumference of the material. In a preferred embodiment of the invention, there are at least one, and preferably two projections 60 and 61 at the ends 62, 63 of the frame 40 of the vanes 80. These two projections 60 and 61 fit into holes openings around the circumference 316 of hub locks 308 and 309. More specifically, and in the preferred embodiment of the invention, one projection fits into the one of the plurality of opening 315 of one of the hub locks 308, 309, and the other projection fits into one of the plurality of openings 320 of one of the other hub locks 308, 309. In the preferred embodiment of the invention, a bulbous 360 or cylindrical 361 head or structure is positioned at the end of the projections, fitting into the large headed grooves 316.

To insert the vanes, the top section 310 and the bottom section 311 of the hub locks 308 and 309 are separated. The projection 60, 61of the vane is inserted in the appropriate slot, with the bulbous head 360 of the projection fitting into the head of the large headed grooves 317.

It should be noted that where there are may be one or two hub locks used, when a vane has two projections. Alternatively, one disk type structure 381 taught in Skwarek may be used to hold the projection of the vane in place. Similarly, one of the projections does not have to be fitted into a hub lock, nor does that projection not entering a hub lock need to have a bulbous head.

It should be noted that the holes or large headed grooves in the two disk type structures into which the two projections of the vains 80 do not have to be in alignment. Indeed, it may be preferable that the two projections 60, 61 at the ends 62, 63 of the frame 40 of the vains 80 not lie in the same plane with each other in relation to the plane of the hollow rod 70, thereby twisting the vane 80. This in turn allows the vain to catch the wind, and permits the hollow rod 70 about the rigid piece 22 to rotate and to direct the entire top structure 21.

In yet another embodiment of the invention, as shown in figure I1, the front section 303 of the wind wheel has a flexible material 304 stretched over a frame comprising several framing pieces 305. The ends 306 of these framing pieces 305 fit into a circular hub lock 308.

In a preferred embodiment of the invention, the material 50 used to make up the fabric part of the structure is ripstop nylon, and the ground stake and extension piece is made out of fiberglass. It is also preferred that the front section have a main supporting rod 200 which makes up part of the frame structure. This gives the device strength, and durability. This supporting rod may be an integral part of the frame of the structure.

The hub locks may be used for a variety of wind wheels and kites. For instance, some kites 405 have propellers 400 or tails 401 that may rotate about an axis or support bar 403 of a kite. This same device can be used to hold the propellers or kite tails.

Some wind wheels have a body 500, usually in the shape of an animal or bird, wherein a center stick 501 has, on each side, two hubs 502, 503 on each side 504, 505 of the body 500. The center stick goes through the pivot doll atop the extension piece. The hub locks can be used to hold the projections, and the vanes, in place. In this type of wind wheel, the vanes may be in the shape of wings, frog legs, or any other form.

There are alternative designs to the hub locks used in the present invention. In one embodiment of the invention, resilient members 370, preferably two, having a grooved tongue 371 extend from and are integral with the top section 372 of a hub lock 373. A bottom section 374 has ridges 375 which snap securely into the grooved tongue 371 when the top section 372 and the bottom section 374 are pushed together. Sides 376 are positioned perpendicularly to the grooved tongue 371 or to the ridge 375 to prevent the bottom section 374 and the top section 372 from disconnect during use. It is preferred that the resilient members be diametrically positioned from one another.

In another embodiment of the invention for the wind wheel one of the hub locks may be a one of the disk type structures as taught in U.S. Pat. No. 6,206,747.

There are many possible methods for securing the two sections of the hub lock together to prevent vanes and other wind movable parts which rotate about an axis from separating from the wind wheels or kites.

Many modifications and variations of the present invention are possible in light of the above teachings. It is, therefore, to be understood within the scope of the appended claims the invention may be protected otherwise than as specifically described.

What is claimed is:

1. A method of securing the attachment of wind directed movable parts which rotate about a frame, said method comprising:

A) opening at least one circular hub lock, said at least one circular hub lock comprising I) a top section, said top section having a hole through the center of said top section ii) a bottom section, said bottom section having:

a) a hole through the center of said bottom section, which is in alignment with said hole of said top section;

b) openings positioned around the circumference of said bottom section, said c) large headed grooves, into which said holes lead;

iii) securing means to removably secure said top section with said bottom section;

B) inserting at least one said wind directed movable part into said openings positioned around said circumference of said bottom section, said at least one said wind directed movable part having at least one projection which fits into said openings of said bottom section of said at least one hub lock, said at least one said projection having a large headed structures fitting into said large headed grooves;

C) securing said top section to said bottom section; and

D) positioning said at least one circular hub lock properly on said frame.

2. The method according to claim 1, wherein said frame is part of a kite.

3. The method according to claim 2, wherein a propeller is attached to said at least one hub lock on said frame.

4. The method according to according to claim 3, wherein a tail is attached to said at least one hub lock on said frame.

5. The method according to claim 1, wherein said large headed grooves have a bulbous shape.

6. The method according to claim 1, wherein said large headed grooves have a shape into which a cylinder shaped device fits.

7. The method according to claim 1, wherein said frame is part of a wind wheel.

8. The method according to claim 1, wherein said large headed structure of said at least one projection of said at least one said wind directed movable part has a bulbous shape.

9. The method according to claim 1, wherein said large headed structure of said at least one projection of said at least one said wind directed movable part has a cylindrical shape.

10. The method according to claim 1, wherein said top section of said at least one circular hub lock has prongs extending from an underside of said top section, and said bottom section has holes into which said prongs fit.

11. The method according to claim 1, wherein said bottom section of said at least one circular hub lock has prongs which fit into holes in said top section of said circular hub lock.

12. The method according to claim 1, wherein said top section of said at least one circular hub lock has resilient members integral with the sides of said top section, and said bottom section has a ridge, wherein said ridge snaps securely into the grooved tongue when the top section and the bottom section are aligned and pushed together.

13. The method according to claim 1, wherein said at least one circular hub lock is positioned on a hollow rod which fits over said frame.

14. A circular hub lock for securing the attachment of wind directed movable parts which rotate about a frame, said hub lock comprising:

A) a top section, said top section having a hole through the center of said top section through which the frame is fitted B) a bottom section, said bottom section having:

I) a second hole through the center of said bottom section through which the frame is fitted, said hole being in alignment with said hole of said top section, ii) openings positioned around the circumference of said bottom section into which projections of said wind directed movable parts are secured;

iii) large headed grooves, into which said holes lead; and

C) securing mechanism to removably secure said top section with said bottom section.

15. The circular hub lock according to claim 14, wherein said frame is part of a kite.

16. The circular hub lock according to claim 15, wherein projections of a propeller is attached to said hub lock on said frame.

17. The circular hub lock according to claim 15, wherein a tail is attached to said hub lock on said frame.

18. The circular hub lock according to claim 14, wherein said large headed grooves have a bulbous shape.

19. The circular hub lock according to claim 14, wherein said large headed grooves have a shape into which a cylinder shaped device fits.

20. The circular hub lock according to claim 14, wherein said frame is part of a wind wheel.

21. The circular hub lock according to claim 14, wherein said top section of said circular hub lock has prongs extending from an underside of said top section, and said bottom section has holes into which said prongs fit.

22. The circular hub lock according to claim 14, wherein said bottom section of said circular hub lock has prongs which fit into holes in said top section of said circular hub lock.

23. The circular hub lock according to claim 14, wherein said top section of said circular hub lock has resilient members integral with the sides of said top section, and said bottom section has a ridge, wherein said ridge snaps securely into the grooved tongue when the top section and the bottom section are aligned and pushed together.

24. The circular hub lock according to claim 13, wherein said hub lock is affixed to a hollow rod which fits over and rotates about said frame.

25. A wind indicator toy, said wind indicator toy comprising:

A) wind directed movable parts, said wind directed movable parts comprising:
   I) a skeleton;
   ii) a flexible material which surrounds said skeleton;
   iii) projections extending from said skeleton;

B) a frame about which said wind directed movable parts rotate; and

C) a hollow rod which fits over and moves freely about said frame;

C) at least one circular hub lock for securing attachment of wind directed movable parts which rotate about a frame, said hub lock being affixed to said hollow rod, said circular hub lock comprising:

I) a top section, said top section having a hole through the center of said top section through which the frame is fitted ii) a bottom section, said bottom section having:
   a) a second hole through the center of said bottom section through which the frame is fitted, said hole being in alignment with said hole of said top section,
   b) openings positioned around the circumference of said bottom section, wherein said projections are fitted to secure said wind directed movable parts;
   c) large headed grooves, into which said holes lead; and D) securing mechanism to removably secure said top section with said bottom section.

26. The wind indicator toy according to claim 25, wherein said large headed grooves have a bulbous shape.

27. The wind indicator toy according to claim 25, wherein said large headed grooves have a shape into which a cylinder shaped device fits.

28. The wind indicator toy according to claim 25, wherein said top section of said circular hub lock has prongs extending from an underside of said top section, and said bottom section has holes into which said prongs fit.

29. The wind indicator toy according to claim 25, wherein said bottom section of said circular hub lock has prongs which fit into holes in said top section of said circular hub lock.

30. The wind indicator toy according to claim 25, wherein said top section of said circular hub lock has resilient members integral with the sides of said top section, and said bottom section has a ridge, wherein said ridge snaps securely into the grooved tongue when the top section and the bottom section are aligned and pushed together.

* * * * *